US007434960B2

(12) United States Patent
Stuhlmacher, II et al.

(10) Patent No.: US 7,434,960 B2
(45) Date of Patent: Oct. 14, 2008

(54) PLUMBING AND LIGHTING FIXTURE

(76) Inventors: Glen Stuhlmacher, II, 45 Cuenea Ct., San Ramon, CA (US) 94583; Daniel L. Marks, 1781 Courtney Ave., Pleasanton, CA (US) 94588

( * ) Notice: Subject to any disclaimer, the term of this patent is extended or adjusted under 35 U.S.C. 154(b) by 107 days.

(21) Appl. No.: 11/369,719

(22) Filed: Mar. 7, 2006

(65) Prior Publication Data

US 2006/0152917 A1 Jul. 13, 2006

Related U.S. Application Data

(63) Continuation-in-part of application No. 10/745,142, filed on Dec. 22, 2003, now Pat. No. 7,008,073.

(51) Int. Cl.
*F21V 33/00* (2006.01)
*F21S 8/00* (2006.01)

(52) U.S. Cl. ..... 362/253; 362/551; 362/101; 239/18

(58) Field of Classification Search ..... 362/101, 362/96, 253, 800; 239/18
See application file for complete search history.

(56) References Cited

U.S. PATENT DOCUMENTS 4,749,126 A * 6/1988 Kessener et al. ..... 239/12
4,901,922 A * 2/1990 Kessener et al. ..... 239/12
6,021,960 A * 2/2000 Kehat ..... 239/289
6,126,290 A * 10/2000 Veigel ..... 362/96
6,805,458 B2 * 10/2004 Schindler et al. ..... 362/96
7,008,073 B2 * 3/2006 Stuhlmacher, II ..... 362/96

* cited by examiner

*Primary Examiner*—Ali Alavi
(74) *Attorney, Agent, or Firm*—Joyce Lauer; Mark Lauer; Silicon Edge Law Group, LLP

(57) ABSTRACT

A plumbing fixture or bathroom accessory includes a source of visible light, providing a pleasing aesthetic effect. Separate portions of faucet handles and/or spouts can be illuminated individually or as a group. A faucet spout and/or handle can include translucent or transparent material that captures and redirects light from the base, and may have opaque areas that provide other interesting patterns. The faucet light or lights can also serve as a nightlight for a bathroom or kitchen, saving the space that a separate nightlight would require. In another embodiment a light is provided in a faucet spout, which can illuminate a sink for a pleasing effect, and can also serve as a nightlight. The spout can be translucent, carrying light as well as water from its base. Lighted bathroom accessories can include towel bars or rings, toilet paper holders, paper towel holders, robe hooks, soap holders or grab bars.

20 Claims, 9 Drawing Sheets

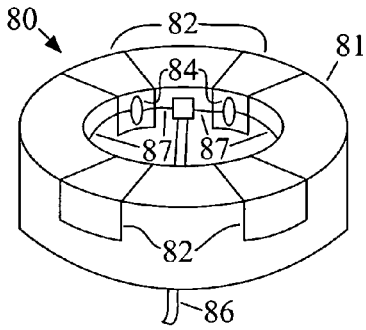
FIG. 21
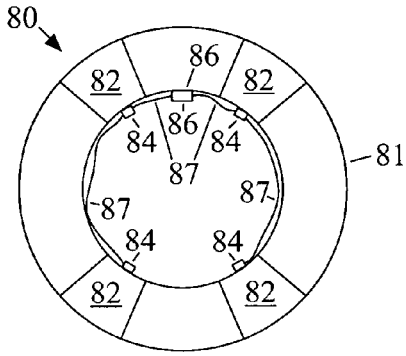
FIG. 22
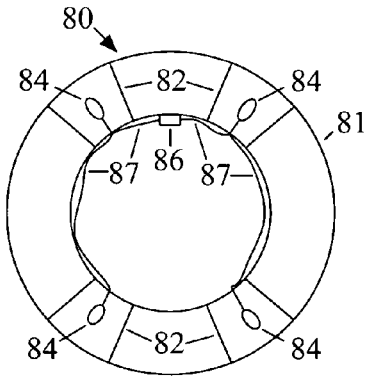
FIG. 23
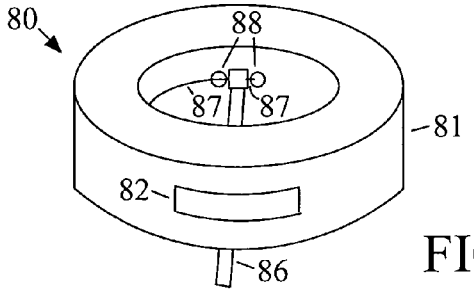
FIG. 25
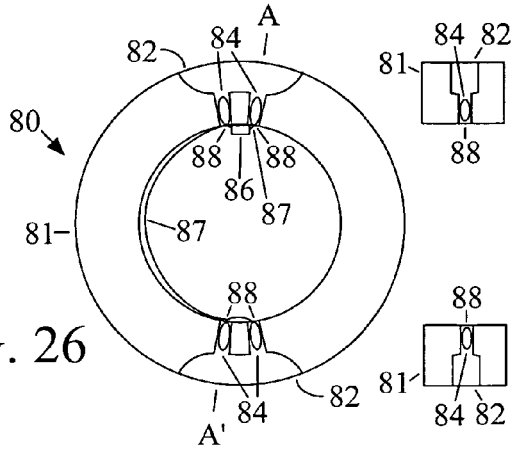
FIG. 26
FIG. 27
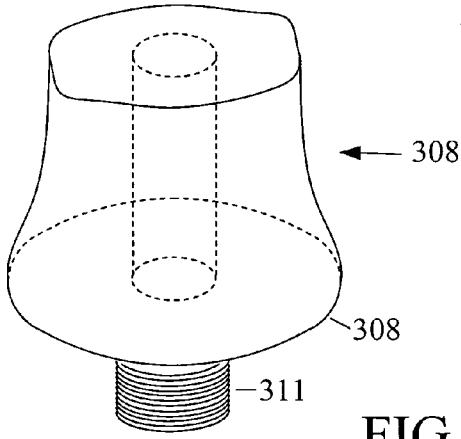
FIG. 24
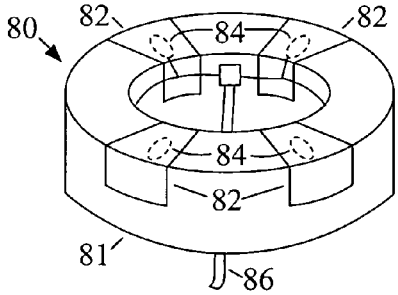

PLUMBING AND LIGHTING FIXTURE

CROSS-REFERENCE TO RELATED APPLICATIONS

The present application is a continuation-in-part of U.S. patent application Ser. No. 10/745,142, filed Dec. 22, 2003 now U.S. Pat. No. 7,008,073, which is incorporated by reference herein.

TECHNICAL FIELD

The present application relates to lighting and plumbing fixtures, such as faucets and lamps.

BACKGROUND

Nightlights are sometimes used in bedrooms or bathrooms to faintly illuminate the rooms at night. Often such lights are not built into a house, however, because of the limited space for light fixtures, and are instead provided by plugging a lamp into a power outlet.

The beauty of light playing with water is well known, as are lighted fountains and showers. Toward this end, U.S. Pat. No. 6,126,290 to Veigel discloses a water draining fixture having a centrally disposed light distributor that is surrounded by water jets, so that the light shines through the water for a pleasing effect. Veigel states that an advantage of this configuration is that a light distributor can be removed and cleaned of calcium deposits, as opposed to a prior patent (WO 95/29300) that veigel states has light fed through a transparent window into the water flowing through the fixture head.

While these patents offer fixtures that illuminate flowing water, neither is optimized for providing lighting or decoration whether the water is flowing or not.

SUMMARY

In one embodiment a plumbing fixture for supplying water to a basin is disclosed that has a spout containing a water conduit, and a handle connected to a valve to control water flow through the water conduit, wherein at least one of the handle and the spout has a base region to hold the fixture adjacent to the basin, the base region containing a lamp, the lamp emitting visible light. For example, the plumbing fixture may be a faucet that is attached to a sink or countertop at a base that also serves as a source of visible light, providing a pleasing aesthetic effect. Separate bases for faucet handles and a faucet spout can be illuminated individually or as a group. A faucet spout and/or handle trim can be made of translucent or transparent material (e.g., acrylic, glass, crystal, etc.) that captures and redirects light from the base. The faucet light or lights can also serve as a nightlight for a bathroom, kitchen, laundry or bar, saving the space that a separate nightlight would require. In another embodiment a light is provided in a faucet spout, which can illuminate a sink for a pleasing effect, and can also serve as a nightlight. The spout can be translucent, carrying light as well as water from its base. In another embodiment a light is provided in a bathroom accessory such as a towel bar or ring, a toilet paper holder, a paper towel holder, a robe hook, a soap holder, a tissue holder, or a toothbrush holder.

DESCRIPTION OF THE FIGURES

FIG. 21 is a perspective view of a part of a plumbing fixture that includes a metal body that supports a plurality of translucent regions.

FIG. 22 is a top view of the plumbing fixture part shown in FIG. 21, including an integrated light source and light transmitter.

FIG. 23 is a top view of a plumbing fixture part similar to that shown in FIG. 22, except that LEDs are embedded within translucent regions.

FIG. 24 is an exploded perspective view of the plumbing fixture part shown in FIG. 23 adjacent the base 308 of the translucent spout 300 depicted in FIG. 12.

FIG. 25 is a perspective view of a part of a plumbing fixture that includes a metal body 81 that supports one or more translucent regions so that a light source is integrated with a light transmitter.

FIG. 26 is a top cross-sectional view of the plumbing fixture part shown in FIG. 25.

FIG. 27 is a side cross-sectional view of the plumbing fixture part shown in FIG. 25.

DETAILED DESCRIPTION OF THE PREFERRED EMBODIMENT

Figure 1:
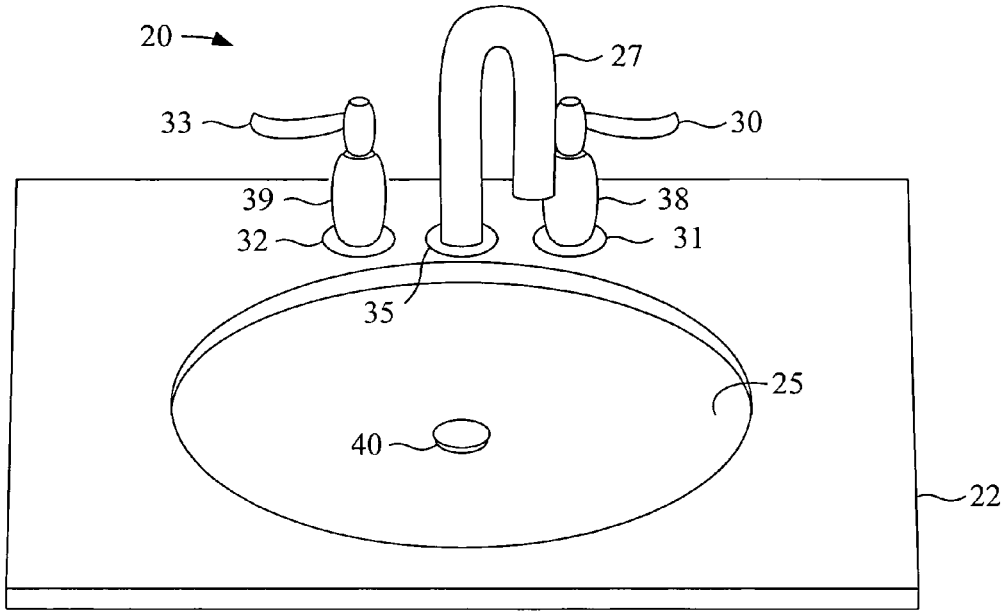
FIG. 1 is a perspective view of a sink with a faucet spout and handles attached at a base that includes a lamp.

FIG. 1 shows a plumbing fixture such as a faucet 20 for supplying water to a basin such as a sink 25, the faucet attached to a countertop 22 and the sink. The faucet includes a spout 27, a right handle 30 and a left handle 33. The spout 27 has a base 35 that is attached to the countertop 22, and the handles 30 and 33 each have a base 31 and 32 that are attached to the countertop. The handles 30 and 33 also each have a shroud or body 38 and 39 that is disposed adjacent to the respective bases 31 and 32. A stop 40 is positioned at the bottom of the sink 25 to control water flow out of the sink. Although difficult to represent in this drawing, bases 31, 32 and 35 are each illuminated, providing a pleasing aesthetic effect.

Figure 2:
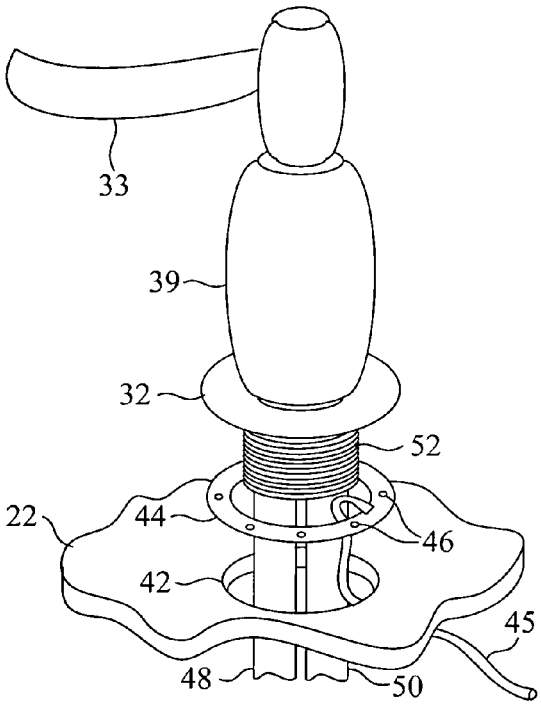
FIG. 2 is an exploded perspective view of one of the handles of FIG. 1.

FIG. 2 is an exploded view of the left handle 33 as it is being attached to the countertop 22 or sink 25 through an aperture 42. The handle 33 may be shaped in many different styles, only one of which is shown. A light source such as a lamp 44 includes a plurality of light-emitting diodes (LEDs) 46 that are affixed to an annular substrate such as a circuit board. A lead wire 45 provides electricity for the LEDs 46 through a plurality of wires that are attached to the substrate 44. The base 32 in this embodiment is made of a translucent material such as acrylic, plastic, glass, crystal, etc., and may act as a lamp shade, lens or surface. As with other embodiments, the translucent material may be transparent, frosted, colored, patterned, etc. Also, the base may have opaque as well as translucent areas, and may be perforated, filigreed, laser etched or otherwise patterned.

A hot water inlet conduit 48 and a hot water outlet conduit 50 protrude through the lamp 44 and aperture 42, with fluid communication between the conduits 48 and 50 controlled by a valve that is connected to the handle 33 within the body 39, as is conventional. A threaded fitting 52 provides an attachment for a nut, not shown, to clamp the body 39 to the countertop 22, thereby fastening the plumbing fixture 20 to the sink area. The base 32 may be pressed directly against the countertop with sealant such as silicone rubber in this embodiment, although a waterproof gasket may also be interposed between the base 32 and the countertop or the substrate may also serve as such a gasket. Instead of mounting on a countertop or sink, the fixture can be mounted on a basin, tub, shower, etc.

Figure 3:
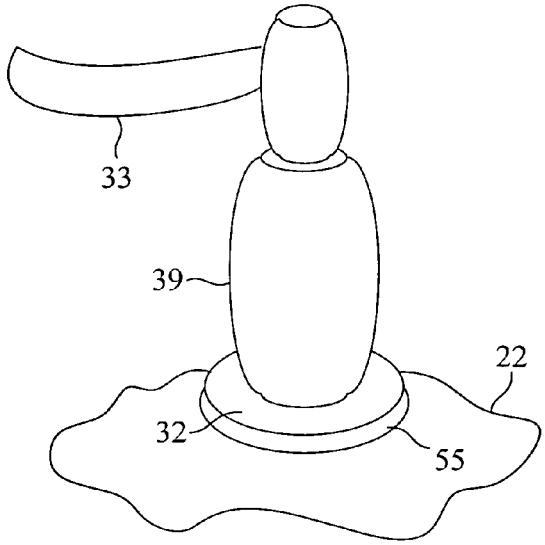
FIG. 3 is a perspective view of a faucet handle having a metal ring disposed at the base, with light emitted from an upper surface of a lamp.

In FIG. 3 a metal ring 55 is clamped between the translucent ring 32 and the countertop 22, with the light emitting from an upper surface of the translucent ring 32. Instead of the ring 55 being made of metal, the ring 55 may be made of other materials such glass, acrylic, plastic, etc.

Figure 4:
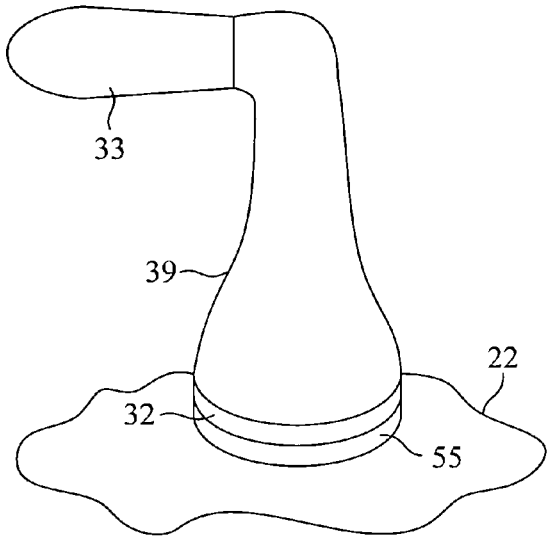
FIG. 4 is a perspective view of a faucet handle having a metal ring disposed at the base, with light emitted from an outer surface of a lamp.

FIG. 4 shows an example in which the metal ring 55 is clamped between the translucent ring 32 and the countertop 22, with light emitting from a side surface of the translucent ring 32. Instead of the ring 55 being made of metal, the ring 55 may be made of other materials such glass, acrylic, plastic, etc.

Figure 5:
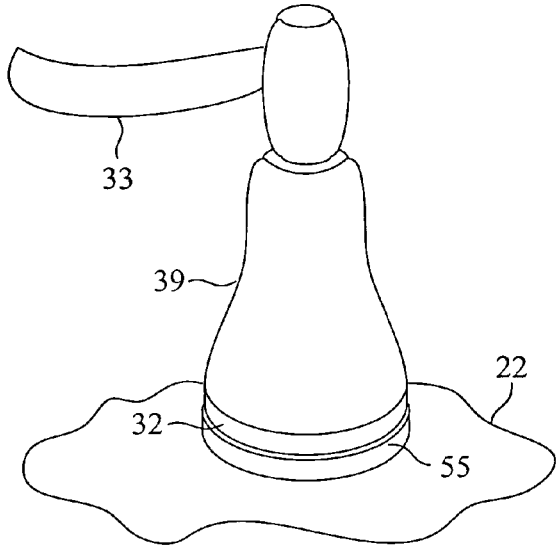
FIG. 5 is a perspective view of a faucet handle having a metal ring disposed at the base, with light emitted from an outer surface of a lamp that fits within the ring.

In FIG. 5 the translucent ring 32 fits within and protrudes above the metal ring 55. The metal ring 55 is clamped between the translucent ring 32 and the countertop 22, with the light emitting from a side surface of the translucent ring 32. Instead of the ring 55 being made of metal, the ring 55 may be made of other materials such glass, acrylic, plastic, etc.

Although depicted in FIG. 1-FIG. 5 as having a smooth surface to facilitate illustration, the translucent ring 32 can have an etched, grooved, corrugated or otherwise uneven surface that refracts light in various patterns. Such an uneven surface can also be formed on an inner surface of the translucent ring 32, for example as a pattern of V-shaped grooves. Such grooves can act as a prism that separates white light into different colors. Also possible is a translucent ring that has metal strips, flakes or other patterns spaced about its periphery.

Figure 6:
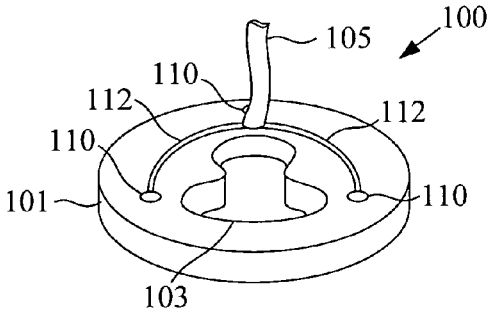
FIG. 6 is a perspective view of a lamp that fits near a base of a faucet spout, the lamp including a plurality of light sources embedded in a translucent block.

FIG. 6 shows a lamp 100 including a translucent substrate 101 that includes at least one light source embedded in the substrate, the substrate 101 designed to fit near a base for a faucet spout. The lamp 100 is turned upside-down from its normal operating orientation to display the integration of the light source into the substrate 101. The substrate 101 is generally ring-shaped and has a pear-shaped aperture 103 near its center to allow a water conduit and rod for a sink stop to pass through, neither of which is shown in this figure. Other shapes for the substrate 101 and aperture are alternatively possible. An insulated electrical lead 105, a cutaway portion of which is shown, connects the light source with a power source, not shown. A plurality of LEDs 110 are disposed in holes in the substrate 101 and are connected to the lead 105 with wires fitting in grooves 112 in the substrate. Light is emitted from the lamp 100 along outer and bottom surfaces of the substrate 101 (in operation from outer and upper surfaces), depending upon which of those surfaces are exposed.

The LEDs 110 may be white or colored, and typically the electricity supplied by the lead 105 is both low voltage and low current, for low power consumption and low risk of shock. For example, the lead 105 may provide direct current of 0.05 to 0.15 amperes at a voltage of between about 2 and 5 volts. A transformer may be provided, not shown, that converts alternating household current of 120 volts to that needed for the LEDs 110. The transformer may be connected to a ground fault circuit interrupter (GFCI) outlet to further reduce risks.

Figure 7:
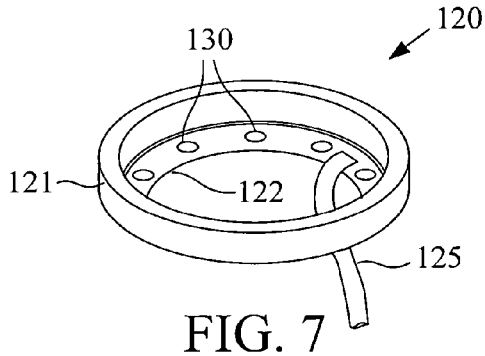
FIG. 7 is a perspective view of a lamp including a plurality of light sources attached to a substrate encircled by a translucent block.

In FIG. 7 a lamp 120 is shown including a translucent ring 121 that surrounds a substrate 122 holding at least one light source, the ring and substrate fitting near a base for a faucet spout or handle. The substrate 122 has an aperture to allow a water conduit and rod for a sink stop to pass through, or to allow a pair of water conduits to pass through. An insulated electrical lead 125, a cutaway portion of which is shown, connects the light source with a power source, not shown. A plurality of LEDs 130 are affixed to the substrate 122 and are connected to the lead 125 with wires attached to the substrate. Light is emitted from the lamp 120 along outer and upper surfaces of the ring 121, depending upon which of those surfaces are exposed. For example, FIG. 5 illustrates a situation in which primarily the outer surface of translucent ring 32 emits light.

Figure 8:
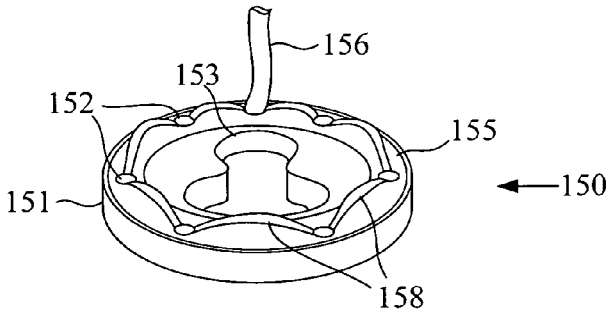
FIG. 8 is a perspective view of a lamp including a plurality of light sources attached to a substrate that fits beneath a translucent block near a base of a faucet spout.

FIG. 8 shows a faucet lamp 150 in which a translucent block 151 is disposed adjacent a substrate 155 holding a plurality of light sources 152, the block and substrate designed to fit near a base for a faucet spout or handle. The lamp 150 is turned upside-down from its normal operating orientation to display the light sources 152 and substrate 155 that shine light up through the block during operation. The block 151 has a pear-shaped aperture 153 near its center to allow a water conduit and rod for a sink stop to pass through, neither of which is shown in this figure. An insulated electrical lead 156, a cutaway portion of which is shown, and a plurality of wires 158 connect the light sources 152 with a power source, not shown. The light sources 152 may be LEDs, the base of which is shown, with the wires depicted in exaggerated fashion to facilitate illustration. Light is emitted from the lamp 150 along outer and upper surfaces of the block 151, depending upon which of those surfaces are exposed. For example, FIG. 2 illustrates a situation in which primarily the upper surface of translucent ring 32 emits light that is visible outside the faucet. Note also that each of the embodiments discussed so far is generally removed from contact with water so that calcium deposits or other water stains are not a problem.

Figure 9:
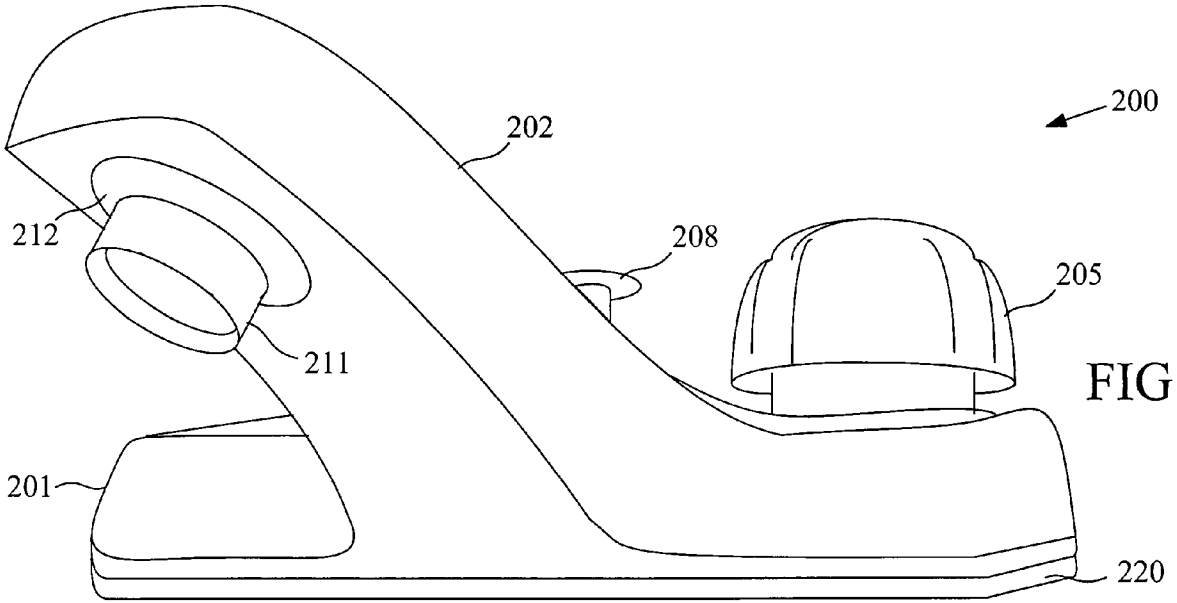
FIG. 9 is a perspective view of a faucet having a substantially unitary body with a lamp disposed near an aerator of a spout.

FIG. 9 shows a faucet 200 having a substantially unitary body 201 that includes a spout as well as handles 205, one of which is hidden from view. A lift rod 208 for a sink stop is also partly hidden from view by the spout 202. An aerator 211 is attached to the spout 202 with a light-emitting block 212 fitted around the aerator and within the spout 202. A base 220 for the faucet 200 may also act as a lamp, much as described before.

Figure 11:
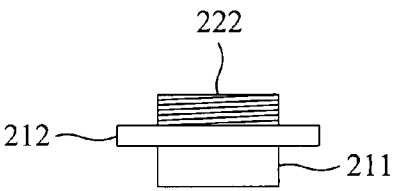
FIG. 11 is a cross-sectional view of the lamp and aerator of FIG. 10.
Figure 10:
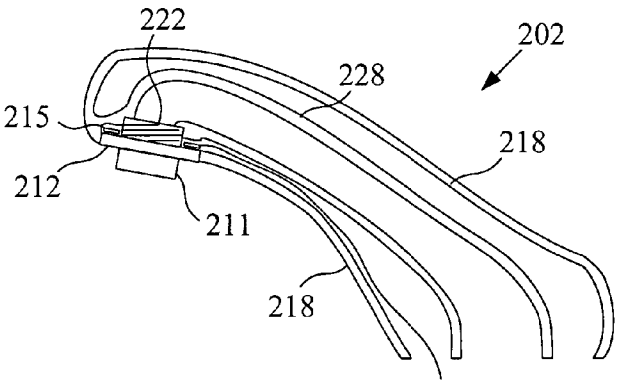
FIG. 10 is a cross-sectional view of the spout of FIG. 9 with the lamp and aerator attached.

As shown in FIG. 10, block 212 is a translucent ring that is seated atop light source 215. Referring also to FIG. 11, translucent ring 212 is attached to the aerator 211, which has a threaded portion 222 for attachment to spout 202. The spout 202 is formed of an exterior wall 218, and has a water conduit 228 into which the threaded portion 215 is screwed. Alternatively, the block 212 may be affixed or threaded to the faucet and the aerator 211 screwed or attached to the block. In another embodiment, the block 212 and/or aerator 211 may be affixed to the faucet by a twist and lock mechanism that may be employed sometimes for commercial applications. Light source 215 may be a ring-shaped substrate holding at least one LED as described above, with an electrical lead 225 providing power to the light source 215. The light-emitting block 212 provides illumination to a sink or other basin that the block faces, accentuating the basin, which can appear to glow. Although a unitary faucet is shown, a separate spout can also hold a light source near the aerator. Note also that this embodiment may contact water, but the light-emitting block 212 can be easily removed for cleaning.

Figure 12:
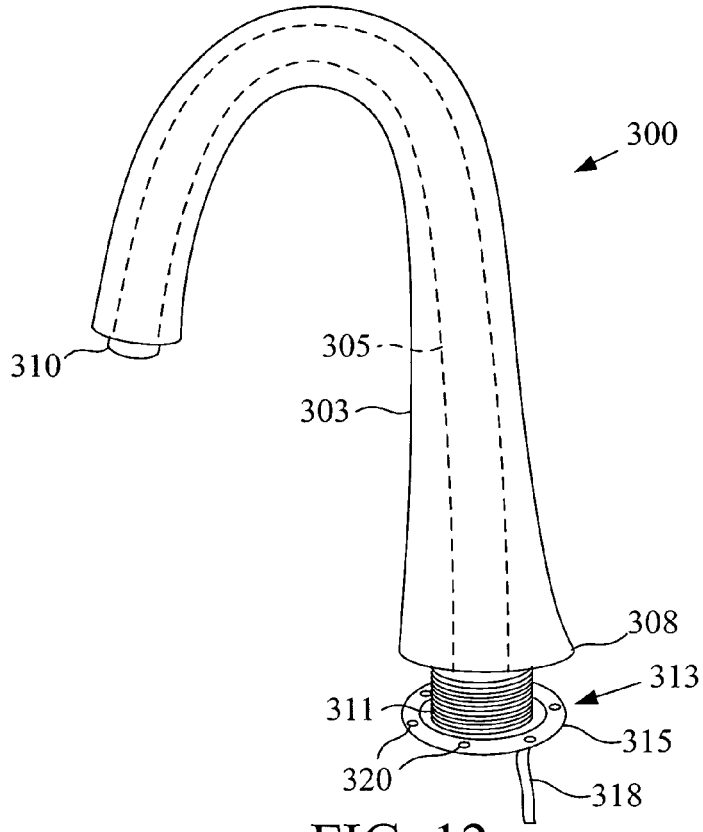
FIG. 12 is a perspective view of a translucent faucet spout with a lamp disposed near the base to illuminate the spout.

FIG. 12 shows a faucet spout 300 including a body 303 that is made entirely of translucent material, such as acrylic, plastic, glass, crystal, etc., which may be clear, frosted or colored. The body 303 encircles a water conduit 305 that provides fluid communication between a base 308 of the spout and an aerator 310. The base 308 is attached to a threaded portion 311 that fits through a hole in a sink top or countertop, not shown in this figure. A light source 313 fits around the threaded portion 311 and beneath the base 308 to illuminate the spout 300. The light source includes a substrate 315 that holds a number of LEDs 320, each of which is connected to an electrical lead 318.

The body 303 has an index of refraction that is greater than that of the air, and so some of the light from the light source 313 flows through the gently curving body to exit near the aerator 310. Stated differently, the body 303 forms a conduit for both water and light. When water flows through the water conduit 305 light may also flow through the water to exit at the aerator 310, which may also be translucent, as an illuminated stream of water. An outer surface of the body may be frosted or may include patterns that reflect or transmit the light. For example, the outer surface may include a plurality of ridges that spiral in helical fashion between the base and the aerator, the ridges transmitting relatively more light so that the helical pattern is accentuated. Alternatively, the outer surface can be encased in metal, plastic or any other hygienically approved material so that the light exits the spout in a ring around the aerator, and also from the aerator for the situation in which the aerator is translucent.

The plumbing light fixtures discussed above can be controlled in various ways. LEDs use little power and can be left on all the time, with the light sources providing beauty and interest to a sink, shower or bathtub area at all times, and also providing a night light for the bathroom for safety and convenience. Alternatively, a faucet lamp can be connected to a switch that is controlled by a light sensor, so that the lamp turns on automatically at night when other bathroom lights are off. As another example, a manually operated switch can be provided, and the switch can be located near other light switches for the room containing the faucet. The plumbing light fixtures can be provided with new construction or remodeling, and can also retrofit existing basins, fixtures and/or faucetry.

The LEDs can emit specific colors or essentially white light. For example, lights for faucet handles can be red for the hot water handle and blue for the cold water handle. Alternatively, the lights can be selected to match or contrast other colors in a room. Translucent blocks through which the light passes are helpful in dispersing light from an individual LED to avoid glare. Such blocks can be transparent or frosted, and can be colored separately from the light sources. Refractive and diffractive effects can also be employed to split multicolored or white light into various colors. The LEDs can be waterproof, and are also disposed within a sealed compartment such as a faucet base or spout.

Figure 13:
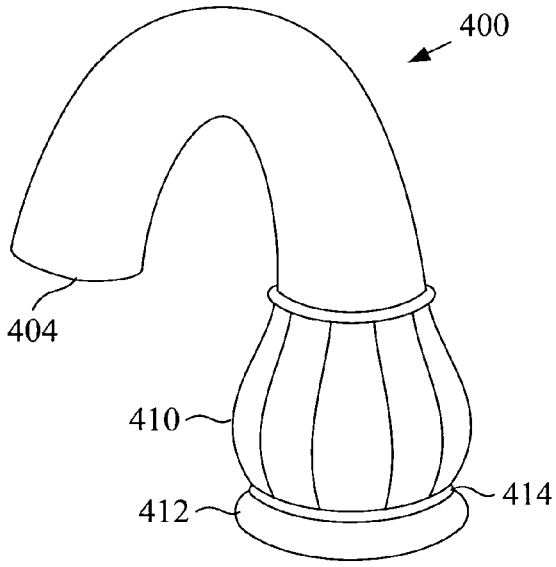
FIG. 13 is a perspective view of a faucet spout with a translucent shroud disposed near the base to provide illumination.

FIG. 13 shows a faucet spout 400 with a translucent shroud 410 disposed near a base 412 of the spout for illumination. The shroud 410, which may sometimes be called a bell or escutcheon, may be made of crystal, glass, acrylic or other materials. The shroud 410 is located in the base region of the spout because it is closer to the base 412 than to a tip 404 of the spout. A light source such as a plurality of LEDs disposed on a ring 414 shines light on an inner surface of the shroud 410, which transmits the light through its outer surface. Such a light emitting shroud may also or alternatively be located on faucet handle, not shown.

Figure 14:
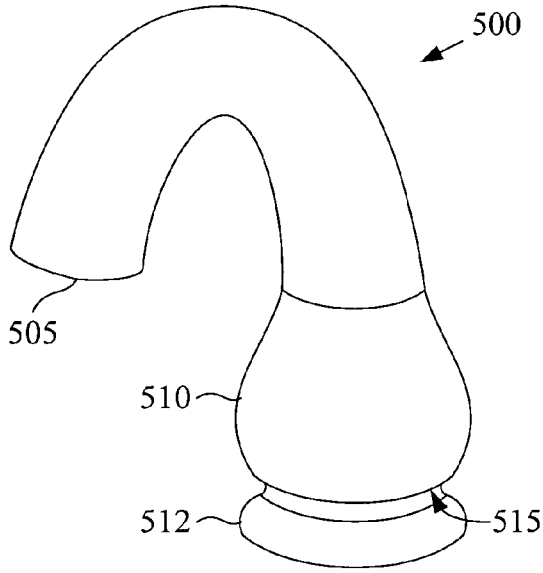
FIG. 14 is a perspective view of a faucet spout with a shroud disposed near the base to illuminate the base.

FIG. 14 shows a faucet spout 500 with an opaque shroud 510 disposed near a base 512 of the spout. The shroud 510 has a skirt 515 that transmits light downward onto the base 512 to illuminate the base.

Figure 15:
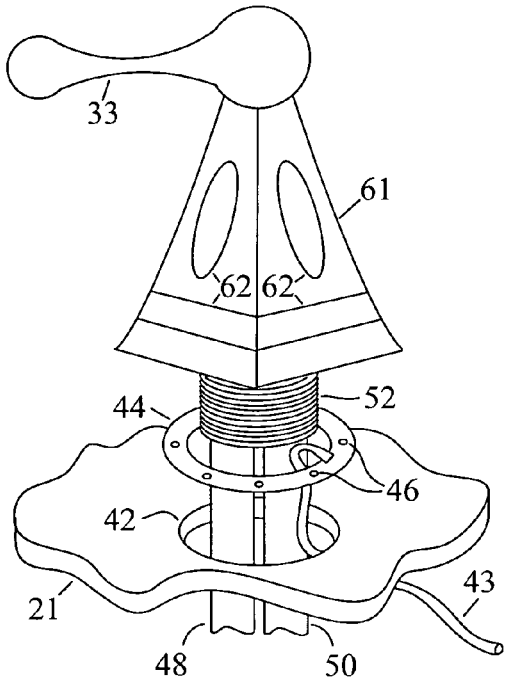
FIG. 15 is a perspective view of a plumbing fixture having a handle attached to a shroud with a rectangular shape that transmits light.

FIG. 15 shows a partially assembled view of a plumbing fixture for mounting on a support 21 adjacent an aperture 42, the plumbing fixture having a handle 33 connected to a conventional valve that controls water flow through water inlet conduit 48 and outlet conduit 50. The plumbing fixture includes a light source 44 that emits visible light, the light source having an electrical lead 43 that extends through the aperture 42. The plumbing fixture also includes a light transmitter 61 having translucent regions 62 for transmitting light from the light source 44. The light transmitter 61 has a void in which at least a part of the valve or the water inlet conduit 48 is disposed. When the fixture is assembled by threading a nut onto threaded fitting 52, LEDs 46 on light source 44 can emit light that passes through the void for transmission by the light transmitter 61.

The support 21 can take various forms, including as appropriate a countertop, a rim of a basin, a rim of a bathtub, a bathtub enclosure, a shower enclosure or a building wall, such as an interior wall for an old-style kitchen sink, or an exterior wall for a garden faucet.

Figure 16:
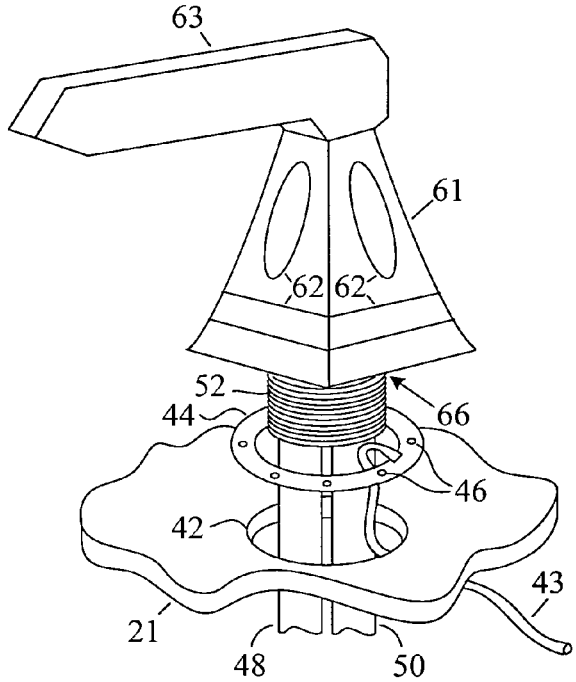
FIG. 16 is a perspective view of a plumbing fixture having a spout attached to a shroud with a rectangular shape that transmits light.

FIG. 16 shows another partially assembled view of a plumbing fixture for mounting on a support 21 adjacent an aperture 42, the plumbing fixture having a spout 63 through which water can flow via water inlet conduits 48 and 50. The plumbing fixture includes a light source 44 that emits visible light, the light source having an electrical lead 43 that extends through the aperture 42. The plumbing fixture also includes a light transmitter 61 having translucent regions 62 for transmitting light from the light source 44. The light transmitter 61 surrounds a void within which a base region 66 of the spout 63 is disposed. When the fixture is assembled by threading a nut onto threaded fitting 52, LEDs 46 on light source 44 can emit light that passes through the void for transmission by the light transmitter 61.

Figure 17:
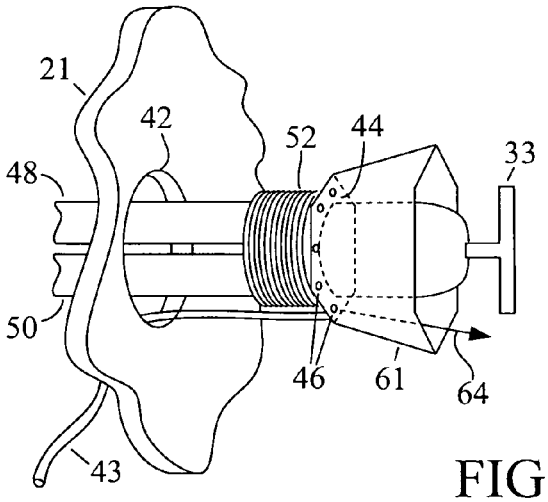
FIG. 17 is a perspective view of a plumbing fixture having a vase shaped shroud that transmits light in substantially the same direction as water flows in an inlet conduit.

FIG. 17 shows a partially assembled view of a plumbing fixture for mounting on a support 21 adjacent an aperture 42, the plumbing fixture having a handle 33 connected to a conventional valve that controls water flow through water inlet conduit 48 and outlet conduit 50. The plumbing fixture includes a light source 44 that emits visible light, the light source having an electrical lead 43 that extends through the aperture 42. The plumbing fixture also includes a light transmitter 61 for transmitting light from the light source 44. The light transmitter 61 has a void in which at least a part of the valve or the water inlet conduit 48 is disposed. When the fixture is assembled by threading a nut onto threaded fitting 52, LEDs 46 on light source 44 can emit light from a void in the light transmitter 61, as shown by arrow 64. In this case, light 64 from the transmitter 61 is directed away from the support 21 in substantially the same direction as water flows in the inlet conduit 48. The transmitter 61 in this case may be shaped similar to a vase or flower for artistic effect, and may open sideways or downward or have holes that allow water to escape from the vase. In another embodiment, not shown, a base region of a spout is disposed within the void of light transmitter 61.

Figure 18:
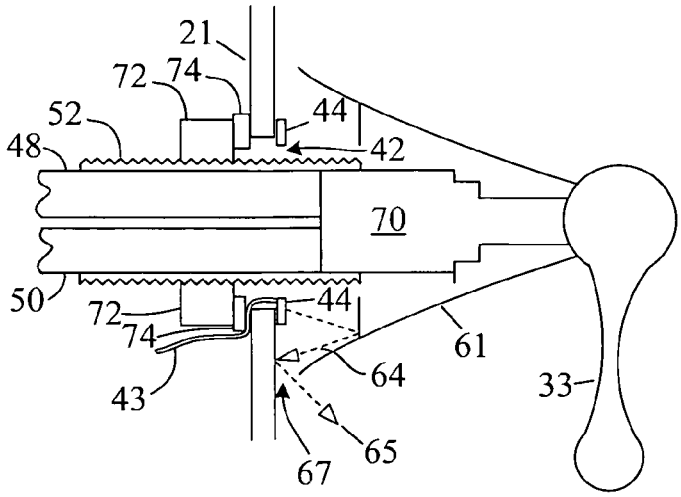
FIG. 18 is a cross-sectional view of a plumbing fixture that is mounting on a support with a shroud that is separated from the support by a gap so that the light from a light source is transmitted through the gap.

FIG. 18 shows a cross-sectional view of a plumbing fixture that is mounting on a support 21 adjacent an aperture 42, the plumbing fixture having a handle 33 connected to a conventional valve 70 that controls water flow through water inlet conduit 48 and outlet conduit 50. The plumbing fixture includes a light source 44 that emits visible light, the light source having an electrical lead 43 that extends through the aperture 42. A shroud 61 that partly encloses the light source 44 is separated from the support 21 by a gap 67, so that the light is transmitted by the shroud through the gap.

A nut 72 is threaded onto threaded fitting 52, holding a washer 74 or gasket that clamps the fixture to support 21. LEDs on light source 44 can emit light from within the shroud 61, as shown by arrow 64, which is redirected to emerge as shown by arrow 65 from a gap 67 between the transmitter 61 and the support 21. Although the washer 74 can clamp the fixture without damaging the lead 43, the washer 74 can optionally have a small milled region that provides space for the lead. Alternatively, such a gasket 74 or washer can have a gap rather than a recess for the lead 43. For example, a lock washer can be clipped or bent to provide a gap for the lead between its ends.

Figure 19:
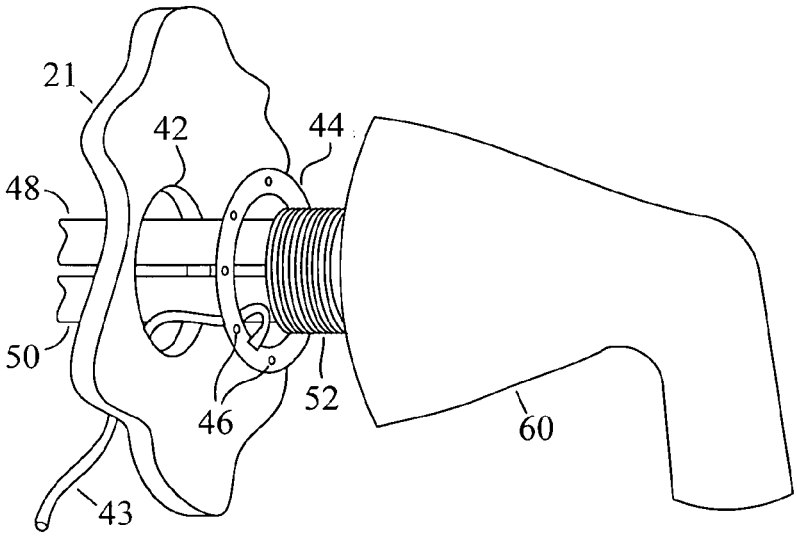
FIG. 19 is a perspective view of a plumbing fixture having a handle integrated with a shroud that terminates adjacent to a support when assembled, with a gap separating the shroud and the support so that light is transmitted from the light source through the gap.

FIG. 19 shows a partially assembled view of a plumbing fixture for mounting on a support 21 adjacent an aperture 42, the plumbing fixture having a handle 60 connected to a conventional valve that controls water flow through water inlet conduit 48 and outlet conduit 50. The plumbing fixture includes a light source 44 that emits visible light, the light source having an electrical lead 43 that extends through the aperture 42. In this case, the handle is integrated with a shroud that terminates adjacent the support 21 when assembled, with a gap separating the handle and the support so that light is transmitted from the light source 44 through the gap. Although shown as a substantially unitary piece 60, the handle and a shroud can be coupled such that the shroud rotates with the handle. When the fixture is mounted by threading a nut onto threaded fitting 52, LEDs 46 on light source 44 can emit light from a void in the light transmitter 61.

Figure 20:
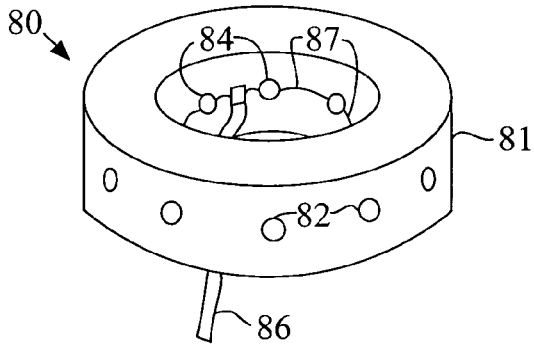
FIG. 20 is a perspective view of a part of a plumbing fixture that has a metal body drilled with holes into which LEDs.

FIG. 20 shows a perspective view of a part of a plumbing fixture that may be used with various handles or spouts such as those previously described. In this case a light transmitter 80 includes a metal body 81 that supports a plurality of translucent regions 82. The light source includes a plurality of light-emitting diodes (LEDs) 84 that are disposed within the metal body 81 adjacent the translucent regions 82, so that the light source is integrated with the light transmitter. Leads 86 and 87 provide power to the LEDs 84. The LEDs 84 fit within holes that that are sized for the LEDs, and the holes may be drilled to form translucent regions 82, which may optionally be filled with translucent material. Alternatively, a translucent sheath can surround the body 81 and regions 82.

FIG. 21 shows a perspective view of a part of a plumbing fixture that may be used with various handles or spouts such as those previously described. In this case a light transmitter 80 includes a metal body 81 that supports a plurality of translucent regions 82. The light source includes a plurality of light-emitting diodes (LEDs) 84 that are disposed within the metal body 81 adjacent the translucent regions 82, so that the light source is integrated with the light transmitter. Leads 86 and 87 provide power to the LEDs 84.

FIG. 22 shows a top view of the plumbing fixture part shown in FIG. 21, including an integrated light source and light transmitter. The LEDs in this case may be attached to an interior wall of the light transmitter 80 adjacent to the translucent regions 82.

FIG. 23 shows a top view of a plumbing fixture part similar to that shown in FIG. 22, except that LEDs 84 are embedded within translucent regions 82. The translucent regions 82 shown in FIGS. 21-24 can be made, for example, by epoxy or plastic that is formed in openings made, for instance, by milling the metal body 81.

FIG. 24 is an exploded perspective view of the plumbing fixture part shown in FIG. 23 adjacent the base 308 of the translucent spout 300 depicted in FIG. 12. The threaded portion 311 of the spout passes through the light transmitter 80 to clamp the transmitter between the base and a support, not shown. The embedded LEDs 84 can then shine through the spout, with the metal portion 81 providing support for the translucent regions 82.

FIG. 25 shows a perspective view of a part of a plumbing fixture that may be used with various handles or spouts such as those previously described. In this case a light transmitter 80 includes a metal body 81 that supports one or more translucent regions 82. The light source includes a plurality of light-emitting diodes (LEDs), not shown in this figure, that are disposed within the metal body 81 adjacent the translucent regions 82, so that the light source is integrated with the light transmitter. Leads 86 and 87 provide power to the LEDs 84.

FIG. 26 is a top cross-sectional view of the plumbing fixture part shown in FIG. 25, and FIG. 27 is a side cross-sectional view of the plumbing fixture part shown in FIG. 25. To make the part shown in FIGS. 25-27, the metal body may be milled out in the translucent regions, and holes 88 drilled into which LEDs 84 can be fitted. The translucent regions 82 may be filled with translucent material or left empty. The LEDs 84 may be attached to an interior wall of the light transmitter 80 adjacent to the translucent regions 82, fitted snuggly in the holes 88, attached to the translucent material or embedded in the translucent material.

Figure 28:
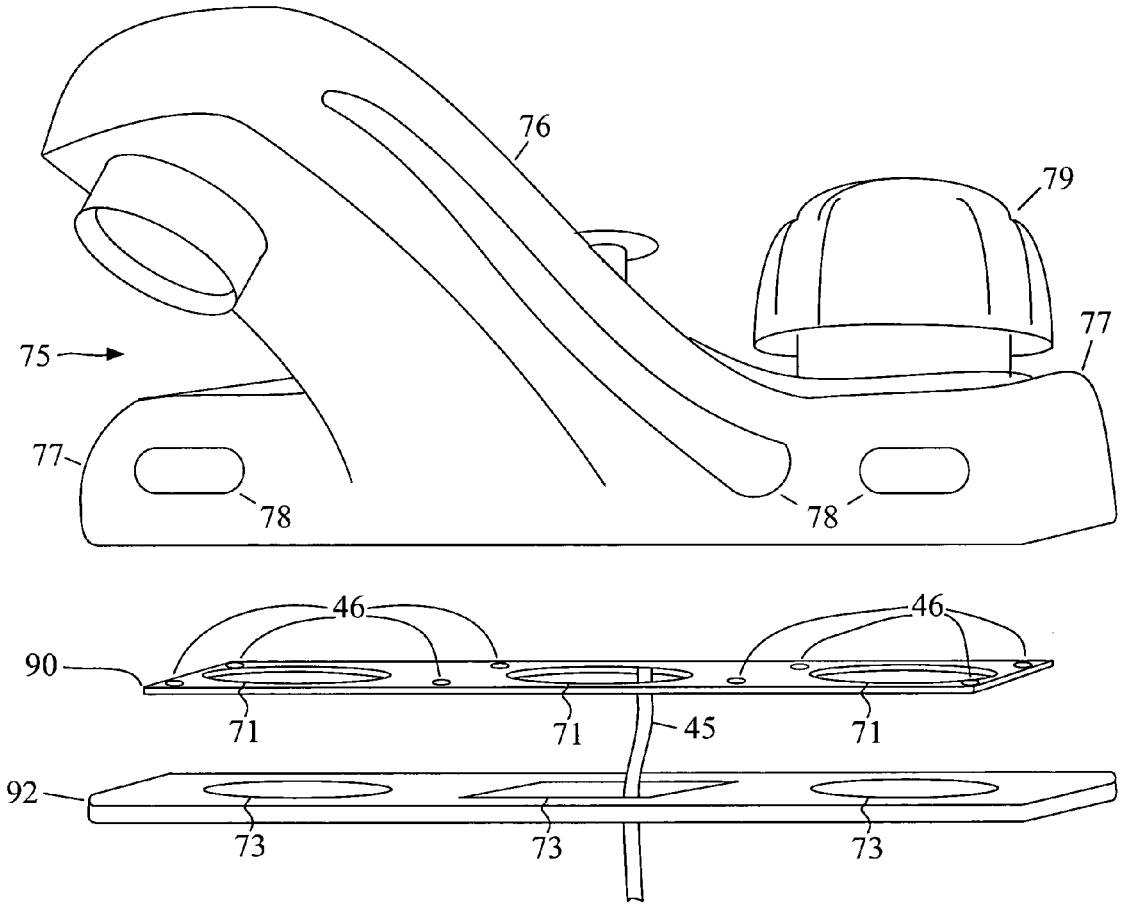
FIG. 28 is an exploded perspective view of a lighted plumbing fixture similar to that shown in FIG. 9 including a plurality of translucent portions.

FIG. 28 is an exploded perspective view of a lighted plumbing fixture similar to that shown in FIG. 9. Faucet 75 has a substantially unitary body that includes a spout 76 as well as handles 79, one of which is hidden from view. Faucet 75 has translucent portions 78 on the spout 76 and body adjacent shoulders 77. A handle 79 is connected to a conventional valve that controls water flow through the spout 76. A light source 90 such as a printed circuit board has LEDs 46 that emit visible light for transmission through translucent portions 78, the light source having an electrical lead 45 that is adapted to extend through one of several apertures 71 of the board 90 and through one of several apertures 73 of a gasket 92 and through one of several apertures in a support such as a sink or countertop, not shown in this figure.

Figure 29:
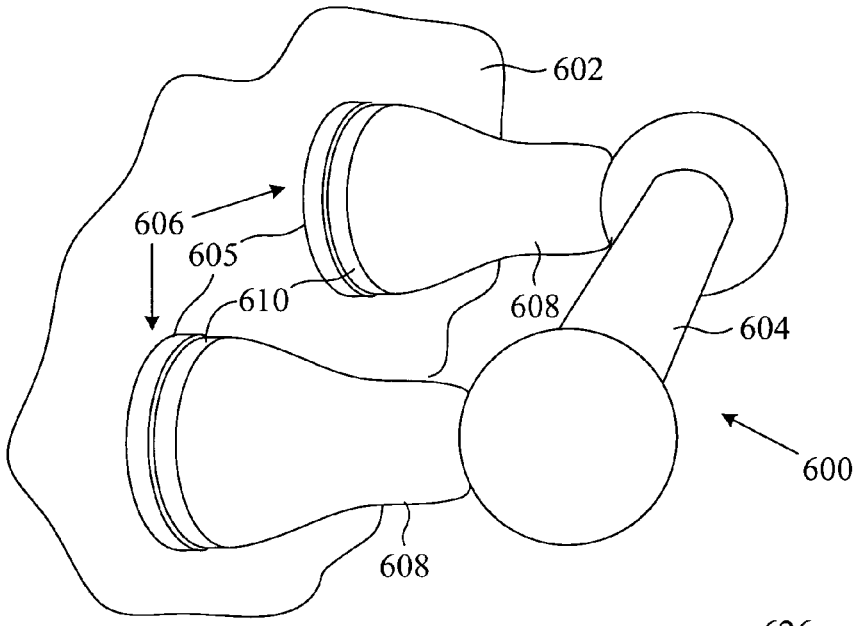
FIG. 29 is a perspective view of a lighted bathroom accessory such as a toilet paper holder or towel bar that is mounted on a support surface such as a wall.

FIG. 29 is a perspective view of a lighted bathroom accessory 600 such as a toilet paper holder or towel bar for mounting on a support surface 602, the bathroom accessory including a base 606 that is adapted to attach to the support surface 602. The bathroom accessory 600 includes an article holder 604 attached to the base by a pair of arms 608, the article holder adapted to removably hold an article such as a towel or toilet paper that is removed from the article holder for use in the bathroom. The base 606 includes an opaque portion 605 and a translucent portion 610 in this example, or the arm 608, which may be considered an extension of the base, may be translucent.

Figure 30:
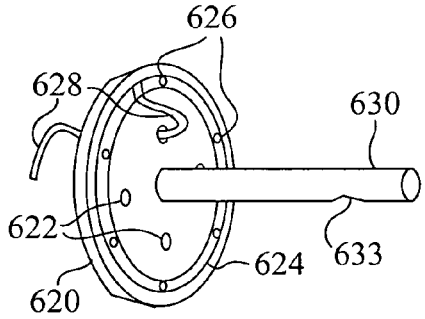
FIG. 30 is a perspective view of a bracket that can be used to attach the lighted bathroom accessory of FIG. 29 or FIG. 31 to a support such as a wall.

FIG. 30 is a perspective view of a bracket 620 that can be used to attach the base 606 to the surface 602, with a light source 624 contained in the base, the light source having a plurality of LEDs 626 that emit visible light that is transmitted out of the base. The bracket 620 has a plurality of holes 622, two of which can be used for attachment and the third for threading a lead 628 through the surface 602. Alternatively, a conventional battery can be contained in the base or arm for powering the light source. The bracket 620 has a central shaft 630 that projects away from the support surface, not shown in this figure, with a notch 633 adapted for receiving a set screw that is threaded in the arm 608 to hold the bathroom accessory to the surface.

Figure 31:
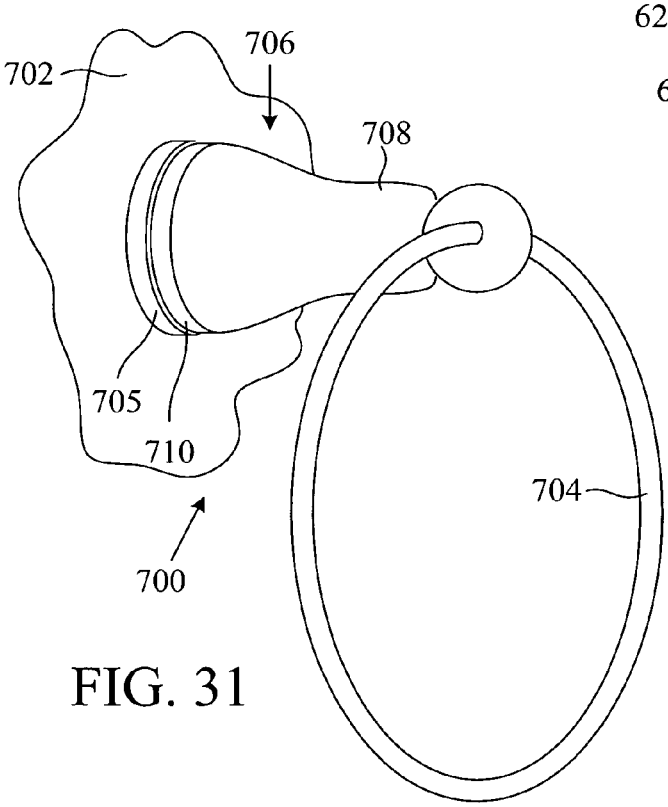
FIG. 31 is a perspective view of a lighted bathroom accessory such as a towel ring that is mounted on a support surface such as a wall.

FIG. 31 is a perspective view of a lighted bathroom accessory 700 such as a towel ring for mounting on a support surface 702, the bathroom accessory including a base 706 that includes an arm 708 and is adapted to attach to the support surface 702. The bathroom accessory 700 includes an article holder 704 attached to the base, the article holder adapted to removably hold an article such as a towel that is removed from the article holder for use in the bathroom. The base 706 includes opaque portions 705 and 710, and translucent portion 708 in this example.

Figure 32:
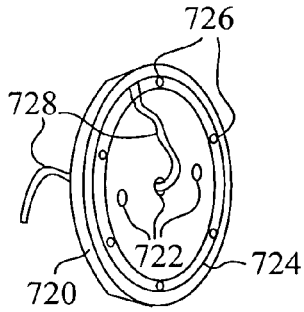
FIG. 32 is a perspective view of a bracket that can be used to attach the lighted bathroom accessory of FIG. 29 or FIG. 31 to a support such as a wall.

FIG. 32 is a perspective view of a bracket 720 that can be used to attach the base 706 to the surface 702, with a light source 724 contained in the base, the light source having a plurality of LEDs 726 that emit visible light that is transmitted out of the base. The bracket 720 has a plurality of holes 722, two of which can be used for attachment and the third for threading a lead 728 through the surface 702. Alternatively, a conventional battery can be contained in the base or arm for powering the light source. The bracket 720 is adapted for receiving a set screw that is threaded in portions 705 or 710 to hold the bathroom accessory to the surface.

Instead of a towel or toilet paper holders, such a lighted bathroom accessory can be a paper towel holder, a robe hook, a soap holder, a tissue holder, or a toothbrush holder, for example. As another example, a grab bar or handrail for a bathroom can have a lighted base much as described and depicted above, which may be advantageous especially for handicapped individuals in finding and utilizing such a support and safety feature.

Although the present disclosure has focused on teaching the preferred embodiments, other embodiments and modifications of this invention may be apparent to persons of ordinary skill in the art in view of these teachings. For example, although LEDs are used in a preferred embodiment other light sources can alternatively be employed, such as fluorescent, incandescent, fiber optic, etc. Therefore, this invention is to be limited only by the following claims, which include all such embodiments and modifications when viewed in conjunction with the above specification and accompanying drawings.

The invention claimed is:

1. A plumbing fixture for mounting on a support adjacent an aperture, the plumbing fixture comprising:

a spout;

a handle connected to a valve that controls water flow through the spout, the valve connected to a water inlet conduit;

a light source that emits visible light, the light source having an electrical lead adapted to extend through the aperture; and a light transmitter that transmits the light, the light transmitter having a void in which at least a part of the valve or the water inlet conduit is disposed.

2. The plumbing fixture of claim 1, wherein the light transmitter has a translucent portion.

3. The plumbing fixture of claim 1, wherein the light transmitter includes a metal body that supports a translucent portion and the light source includes a light-emitting diode (LED) that is disposed adjacent the translucent portion.

4. The plumbing fixture of claim 1, wherein the light transmitter includes a metal body that supports a translucent portion, the light source is integrated with the light transmitter and the light source includes a light-emitting diode (LED) that is embedded within the translucent portion.

5. The plumbing fixture of claim 1, wherein the light transmitter includes a metal body that supports a translucent portion and wherein the light source includes a substrate and a light-emitting diode (LED) disposed on the substrate.

6. The plumbing fixture of claim 1, wherein the light transmitter is separated from the support by a gap through which the light is transmitted.

7. The plumbing fixture of claim 1, wherein the light transmitter transmits the light in a direction that is substantially away from the support.

8. The plumbing fixture of claim 1, wherein the handle and the light transmitter comprise a substantially unitary piece that rotates to actuate the valve.

9. The plumbing fixture of claim 1, wherein the light transmitter includes a metal body with a plurality of holes, and the light source includes a plurality of light-emitting diodes (LEDs) each of which fits within one of the holes.

10. A plumbing fixture for mounting on a support adjacent an aperture, the plumbing fixture comprising:

a spout;

a handle connected to a valve that controls water flow through the spout, the valve connected to a water inlet conduit;

a light source that emits visible light, the light source having an electrical lead adapted to extend through the aperture; and a light transmitter that transmits the light, the light transmitter having a void in which a base region of the spout is disposed.

11. The plumbing fixture of claim 10, wherein the light transmitter includes a metal body with a hole that is sized for a light-emitting diode (LED), and the light source includes the LED, which is disposed in the hole.

12. The plumbing fixture of claim 10, wherein the light transmitter has a translucent portion.

13. The plumbing fixture of claim 10, wherein the light transmitter includes a metal body that supports a translucent portion and the light source includes a light-emitting diode (LED) that is disposed adjacent the translucent portion.

14. The plumbing fixture of claim 10, wherein the light transmitter includes a metal body that supports a translucent portion, the light source is integrated with the light transmitter and the light source includes a light-emitting diode (LED) that is embedded within the translucent portion.

15. The plumbing fixture of claim 10, wherein the light transmitter includes a metal body that supports a translucent portion and the light source includes a substrate and a light-emitting diode (LED) disposed on the substrate.

16. The plumbing fixture of claim 10, wherein the light transmitter is separated from the support by a gap through which the light is transmitted.

17. The plumbing fixture of claim 10, wherein the light transmitter transmits the light in a direction that is substantially away from the support.

18. A plumbing fixture for mounting on a support adjacent an aperture, the plumbing fixture comprising:

a spout;

a handle connected to a valve that controls water flow through the spout, the valve connected to a water inlet conduit;

a light source that emits visible light, the light source having an electrical lead that extends through the aperture; and a shroud that partly encloses the light source and is separated from the support by a gap, such that the light is transmitted through the gap.

19. The plumbing fixture of claim 18, wherein the handle and shroud form a substantially unitary body.

20. The plumbing fixture of claim 18, wherein the shroud is coupled to the handle and rotates with the handle.

* * * * *

UNITED STATES PATENT AND TRADEMARK OFFICE Certificate

Patent No. 7,434,960 B2 Patented: October 14, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Glen Stuhlmacher, II, San Ramon, CA (US).

Signed and Sealed this Fourth Day of June 2013.

DIANE I. LEE
*Supervisory Patent Examiner*
Art Unit 2875
Technology Center 2800